United States Patent [19]

Calhoun et al.

[11] Patent Number: 4,602,775

[45] Date of Patent: Jul. 29, 1986

[54] MODULAR COVER INSERTER UNIT

[75] Inventors: Lee M. Calhoun; John D. Gross, both of Rochester, N.Y.

[73] Assignee: Eastman Kodak Company, Rochester, N.Y.

[21] Appl. No.: 721,111

[22] Filed: Apr. 8, 1985

[51] Int. Cl.[4] ..... B65H 5/30; B65H 29/00

[52] U.S. Cl. ..... 270/55; 271/186

[58] Field of Search ..... 270/55; 271/184–187, 271/194–197, 5, 9, 12, 94–95, 117, 225, 276, 289, 290, 291; 355/14 SH

[56] References Cited

U.S. PATENT DOCUMENTS

| | | | |
|---|---|---|---|
| 3,689,062 | 9/1972 | Suzuki | 271/117 |
| 3,948,385 | 4/1976 | Shinomiya | 271/186 X |
| 4,147,426 | 4/1979 | Miyoshi et al. | 271/291 |
| 4,192,607 | 3/1980 | Hage | 271/291 |
| 4,248,525 | 2/1981 | Sterrett | 271/289 |
| 4,273,326 | 6/1981 | Snellman et al. | 271/291 |
| 4,365,794 | 12/1982 | Roller | 271/291 |
| 4,368,973 | 1/1983 | Silverberg | 271/186 X |
| 4,421,306 | 12/1983 | Muka | 271/5 |
| 4,456,236 | 6/1984 | Buddendeck | 271/291 |
| 4,459,013 | 7/1984 | Hamlin et al. | 271/186 X |

FOREIGN PATENT DOCUMENTS

| | | | |
|---|---|---|---|
| 17983 | 10/1980 | European Pat. Off. | 271/187 |
| 2493816 | 5/1982 | France | 271/5 |

*Primary Examiner*—E. H. Eickholt

*Attorney, Agent, or Firm*—G. Herman Childress

[57] ABSTRACT

A modular cover inserter unit is located between a copier/duplicator which produces sets of copy sheets and a finisher which forms booklets from the sets of copy sheets. The cover inserter unit includes a sheet transport that advances sheets from the copier/duplicator to the booklet finisher. Covers are stacked on two supports in the inserter unit and fed from the supports to the sheet transport. An inverter in the unit can invert a cover before it reaches the booklet finisher.

6 Claims, 3 Drawing Figures

MODULAR COVER INSERTER UNIT

BACKGROUND OF THE INVENTION

This invention relates to a modular cover inserter unit that can be positioned between a copier/duplicator and a booklet finisher for providing booklet covers to the finisher.

Commonly assigned U.S. Pat. No. 4,473,425, issued Sept. 25, 1984, in the names of R. C. Baughman et al and entitled "Binding Apparatus and Method" discloses finishing apparatus in combination with a copier/duplicator. The finishing apparatus receives sets of copy sheets produced on the copier/duplicator. The sheets are received seriatim in a particular page sequence, one set of sheets after another. The finisher can produce a booklet from each set of copy sheets by delivering the copy sheets to assembly trays in a particular page sequence. While the booklets can be delivered to a tote tray without securing the sheets together, the patent also discloses finishing the booklets either by a stitching operation that staples the sheets of the booklet together or by an adhesive binding operation wherein a liquid adhesive is applied to the sheets and the sheets are then stacked and pressed together to form booklets. Cover sheets for the front and/or back of the booklet can be provided from one of the copy sheet supplies of the copier/duplicator as suggested in Column 20, lines 45–50 of the patent.

While apparatus of the type disclosed in that patent has worked well for its intended purposes, the use of one of the copy sheet supplies for cover sheets has certain disadvantages. First of all, it reduces the number of copy sheet supplies that are available for their normal use, i.e., providing copy sheets on which images are formed. In addition, the booklet covers must be transported along the entire conventional copy sheet path through the copier/duplicator. This path normally includes a number of curves which may limit the size, shape, or thickness of cover stock that can be used for formation of booklets. Clearly it would be advantageous to free the copy sheet supplies for their intended use and minimize the length and complexity of the path for booklet covers.

At times it is desirable to produce booklets with front and back covers that are different in one or more characteristic and thus not interchangeable. For example, the front and back covers can have different pre-printed information thereon, or they can be different colors, or they can be made from different weight cover stock. Booklets can be produced by interleaving front and back covers and placing them in a single supply tray. However, such requires excessive time and effort by an operator and reduces overall productivity of the operator. Also, the operator must be careful that the front and back covers are properly oriented in the supply tray when the covers are printed before loading them into the tray. If the front and back covers are not properly oriented, they may be inverted (front-to-back or top-to-bottom) relative to their desired position in the booklet. This orientation requirement complicates the task of interleaving front and back covers when they are to be fed from a single supply tray.

SUMMARY OF THE INVENTION

An object of the present invention is to provide covers for booklets without using a copy sheet supply of a reproduction apparatus, and without requiring the covers to travel through the copy sheet path of the reproduction apparatus. Another object of the invention is to provide for cover insertion in a way which avoids problems that may be associated with feeding covers of certain sizes, shapes, or thickness through reproduction apparatus. A still further object of the invention is to provide for convenient loading of both front and back booklet covers of a booklet when such covers are different and thus not interchangeable. A still further object of the invention is to provide for insertion of covers for booklets without interleaving the front and back covers when they are not interchangeable. A still further object of the invention is to provide for cover insertion along a sheet path leading to a booklet finisher wherein front and/or back covers can be loaded in their normal (face up) orientation and still be delivered to the booklet finisher in the proper orientation.

In accordance with the present invention, a modular cover inserter unit is adapted to be located between a copier/duplicator (or other reproduction means) and means for assembling booklets from sets of copy sheets received from the copier/duplicator. The inserter unit includes a sheet transport having an inlet for receiving sheets from a copier/duplicator and having an outlet for delivering such sheets to the booklet assembling means. The sheet transport has means for feeding sheets along a path from its inlet to its outlet. Support means in the unit holds a plurality of covers. Cover feeding means removes a cover from the support and delivers the removed cover to the sheet transport between the inlet and the outlet. An inverter located between the support means and the outlet of the sheet transport can invert a cover after it is fed from the support means and before it reaches the booklet assembling means so that the cover is properly oriented when delivered to the assembling means.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
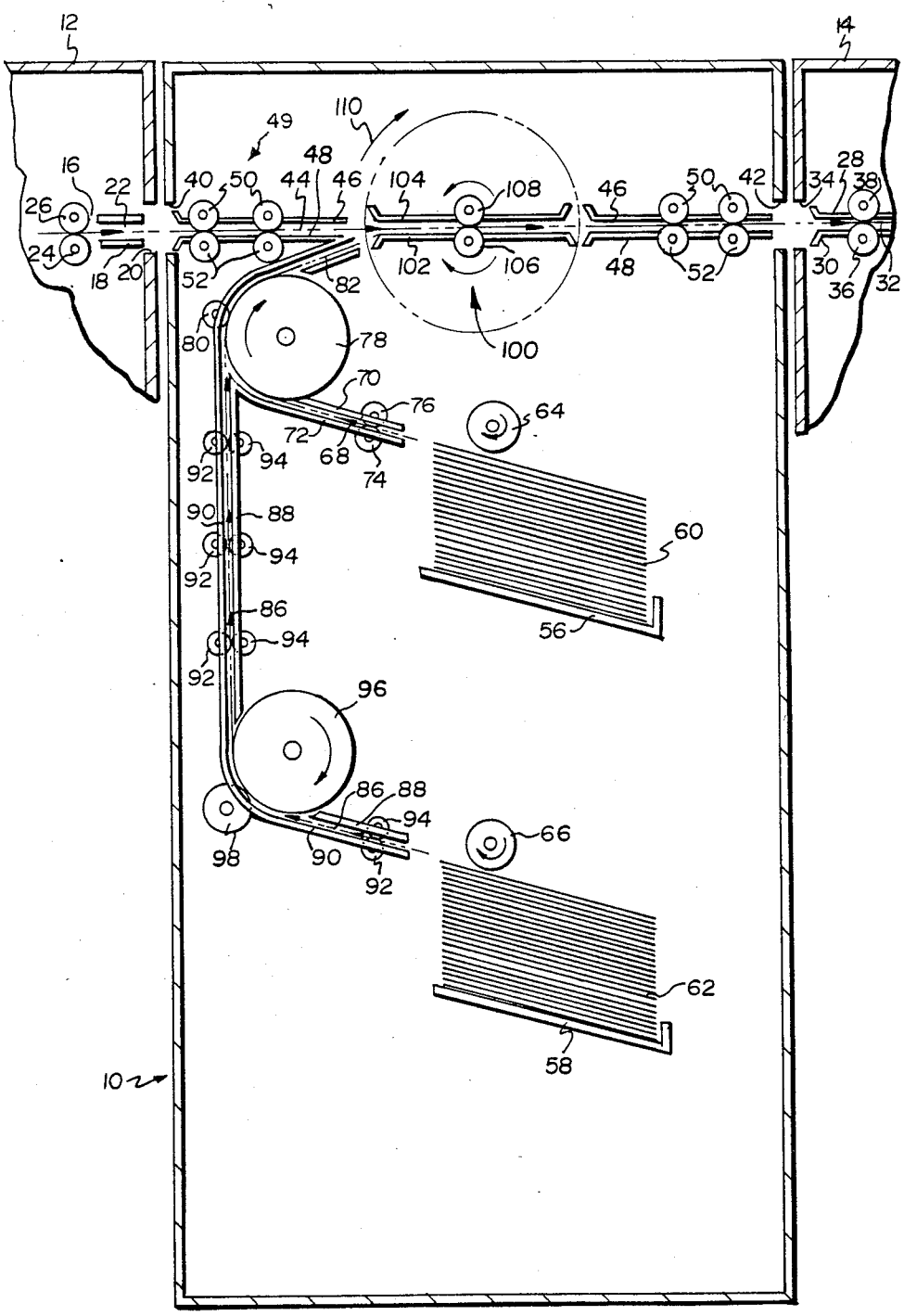
FIG. 1 is a cross-section view illustrating a modular cover inserter unit of the present invention in combination with a copier/duplicator and a booklet finisher.

Referring now to FIG. 1 of the drawings, a modular cover inserter unit of the present invention is generally designated 10. Unit 10 is illustrated as being located between a copier/duplicator 12 and a finisher 14. Only the portion of the copier/duplicator 12 and finisher 14 required to illustrate their relationship to unit 10 have been shown in the drawings. The copier/duplicator and finisher can be of any suitable construction, such as disclosed in U.S. Pat. No. 4,473,425, for example. The finisher assembles booklets from sets of copy sheets received from the copier/duplicator and covers received from unit 10. Copier 12 has a pair of sheet guides 16, 18 terminating at an exit slot 20 and defining a sheet path 22. Copy sheets from the copier/duplicator 12 can be directed along the sheet path 22 to the exit slot 20 in a manner well known in the art. The copy sheets can be driven along path 22 by sets of drive rollers 24, 26 in a conventional manner.

Finisher 14 also has sets of guide members 28, 30 which define a guide path 32 for sheets that enter the finisher through an entrance slot 34. Sheets can be advanced along path 32 by sets of rollers 36, 38.

As disclosed in the before-mentioned U.S. Pat. No. 4,473,425, it is known to provide a copier/duplicator 12 adapted to produce a stream of copy sheets that are delivered seriatim along a sheet path as shown at 22 from the copier/duplicator to the entrance slot 34 and sheet path 32 of a finisher as shown at 14. In that patent the finisher is connected directly to the copier/duplicator. Finisher 14, as disclosed in that patent, is adapted to assemble booklets from sets of sheets delivered seriatim thereto from a copier/duplicator either by stapling the sheets together by means of a stitching operation or by adhesively bonding sheets together to form a booklet. U.S. Pat. No. 4,473,425 also discloses the use of one of the sheet supplies of the copier/duplicator as a supply for covers that are fed along the copy sheet path through the copier/duplicator in properly timed relation to the copy sheets. In order to simplify the explanation of the present invention, and without unnecessarily repeating disclosures set forth in U.S. Pat. No. 4,473,425, such patent is hereby incorporated by reference. While the modular cover inserter 10 of the present invention will be disclosed in connection with such a copier/duplicator and finisher, it will be understood that it can be used with other types of reproduction apparatus and booklet assembling means.

Cover inserter unit 10 has an entrance slot 40 substantially aligned with the exit slot 20 of the copier/duplicator 12. Unit 10 also has an exit slot 42 that is substantially aligned with the entrance slot 34 of the finisher 14. Sheets from the copier/duplicator are guided along a path 44 between the entrance slot 40 and exit slot 42 by sets of guides 46, 48. Sheets are driven along the path 44 by a sheet transport 49 comprising plurality of sets of rollers 50, 52 on opposite sides of the path 44.

Unit 10 has two trays 56, 58 for supporting a plurality of booklet covers. For example, tray 56 can support a stack of booklet covers 60 which are to comprise the front covers of booklets formed in finisher 14 and tray 58 can support a stack of covers 62 that comprise the back covers of booklets. Of course, upper tray 56 could receive the back covers and the bottom tray 58 could receive front covers, if desired. Moreover, at times the covers in both trays 56, 58 can be identical, such occurring either when a booklet produced in finisher 14 is to have identical front and back covers or when the booklet is to have only a single (front or back) cover.

Cover feeding means are provided for removing covers 60, 62 from their respective trays and for delivering the removed cover to the sheet transport 49. The cover feeding means illustrated in FIG. 1 comprises a feed roller 64 for covers 60 and a similar feed roller 66 for covers 62. Rollers 64, 66 can be of a conventional construction including vacuum rollers, scuff rollers, or the like. The cover feeding means described in more detail later in connection with FIGS. 2 and 3 can also be substituted for feeders 64, 66. Trays 56, 58 can be raised and lowered by elevator mechanisms (not shown) so that the top cover on each tray is directly below the respective feeder 64, 66. Elevator mechanisms of the type used for copy sheet supplies in copier/duplicators can be used for this purpose.

A cover 60 fed from the tray 56 by feed roller 64 moves along a path 68 defined by guides 70, 72. Sheets initially are advanced along path 68 by sets of rollers 74, 76. In this manner, the sheets reach the nip between a relatively large roller 78 and a roller 80. Rollers 78, 80 drive the cover through another sheet path 82 that intersects path 44 at an acute angle. Thus, covers 60 can be fed to the same sheet path as the copy sheets received from copier/duplicator 12. After covers reach path 44, they are advanced to finisher 14 by sheet transport 49.

In a similar manner, a cover 62 removed by feed roller 66 travels along a path 86 between sheet guides 88 and 90. Sheets are advanced along the path by a plurality of sets of rollers 92, 94 and by a relatively large roller 96 and a cooperating roller 98. The relatively large rollers 78, 96, being located at the corners of the cover paths 68, 86, facilitates the flow of covers around the corners. The large rollers at the corners also accommodate covers of relatively heavy cover stack. It will be observed that the upper end of path 86 intersects path 68 at roller 78. Thus covers 62 leaving path 86 are delivered to path 82 and then to the path 44 for copy sheets from the copier/duplicator to the finisher.

Preferably, the cover inserter unit 10 has an inverter 100 located along transport 49 between the intersection of paths 82 and 44 and the exit slot 42 of the inserter unit. Inverter 100 comprises sheet guides 102, 104 located on opposite sides of the sheet path 44 and a set of rollers 106, 108 for driving sheets along path 44 through the inverter 100. As indicated by arrow 110, the entire inverter 100 can be rotated about an axis passing through the nip between rollers 106, 108 and in a direction perpendicular to the direction of movement of sheets along path 44 through the inverter. Inverters of this type are known in the art and are disclosed, for example, in U.S. Pat. No. 3,917,256, issued Nov. 4, 1975 in the name of C. J. Kubasta and entitled "Dual Purpose Sheet Handling Apparatus," and in U.S. Pat. No. 3,744,614, issued July 10, 1973 in the names of K. I. Schooter et al and entitled "Rotating Mechanism." Accordingly, inverter 100 has only been illustrated generally in the drawings and may be constructed as disclosed in detail in such patents. In the Kubasta patent the inverter is located between the output of a copier/duplicator and a sorter and is operated to invert sheets, when necessary, in order that they will be properly oriented in the sorter. Other types of known inverters could also be used.

In operation, a cover or a copy sheet is advanced between guides 102, 104 of inverter 100 until at least part of the sheet or cover is between the rollers 106, 108. Then the entire inverter 100 is rotated by 180-degrees as indicated by arrow 110 so that the edge of the sheet or cover that originally is the leading edge of the sheet becomes the trailing edge. Thus the sheet or cover is inverted. Rollers 106, 108 then feed the sheet or cover from the inverter along path 44 to exit slot 42.

The inverter 100 is desirable for several reasons. First of all, in some instances sheets provided along path 22 from the copier/duplicator 12 need to be inverted before they are furnished to the finisher 14. Inverter 100 can invert such sheets. For example, U.S. Pat. No. 3,917,256, mentioned previously, describes copier apparatus that requires inversion of some copy sheets. Secondly, the inverter 100 simplifies instructions for loading covers 60, 62 into the trays 56, 58. With the inverter, the operator can be instructed to load the front covers 60 in tray 56 with the upper surface of the covers being the outside surface of the covers at the front of the finished booklet. Also, the operator can be instructed to load the back covers 62 in tray 58 with the upper surface being the outer surface of the covers in the finished booklets. Thus the upper surfaces of covers 60, 62 in their respective trays comprise the surfaces that ordinarily are printed. Assuming that the copy sheets from the copier/duplicator are to be furnished to the finisher in a face-down relationship for simplex copy sheets and with the odd-numbered page facing down for duplex copy sheets, then the front covers can be fed from tray 56 through paths 82 and 44 to the finisher without inverting the front covers. On the other hand, the back covers 62 will need to be inverted by inverter 100 so that the surface facing up in tray 58 will face up when the sheets are delivered to finisher 14 and therefore be on the outside face or the back of the resulting booklet. Of course, if copy sheets from copier/duplicator 12 are to face up when received by the finisher 14, then the front covers 60 are inverted by inverter 100 and the back covers are not inverted. Thus the provision of inverter 100 assures that the front covers and back covers are received by the finisher in the proper orientation and at the same time simplifies instructions to the machine operator with respect to loading of the covers into the unit 10. Also, inverter 100 eliminates the need for a similar inverter in the copier/duplicator 12 for certain models of copier/duplicators, as disclosed in previously mentioned U.S. Pat. No. 3,917,256.

Figure 2:
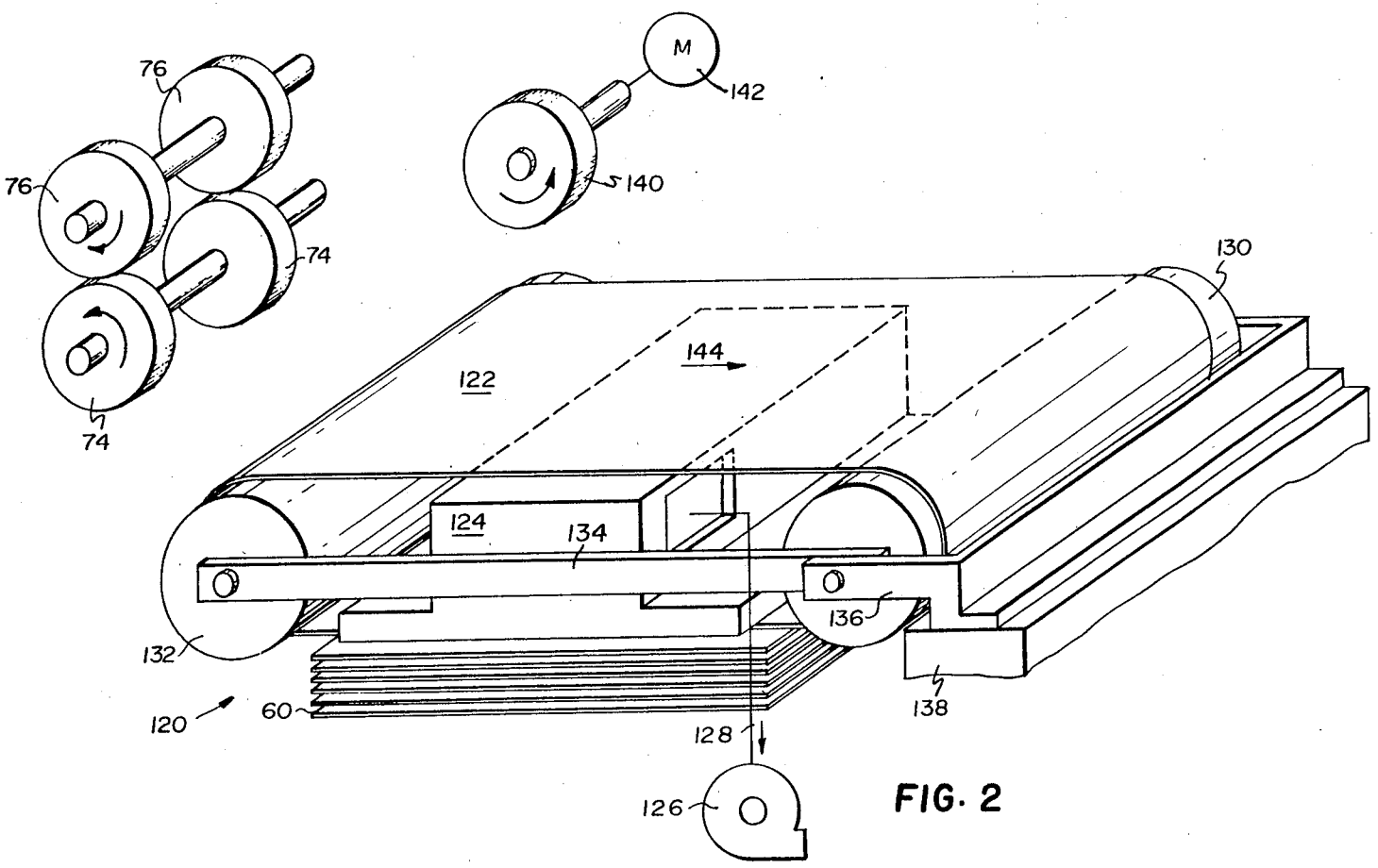
FIG. 2 is a perspective view of a preferred cover feeding mechanism for the cover inserter unit illustrated in FIG. 1.
Figure 3:
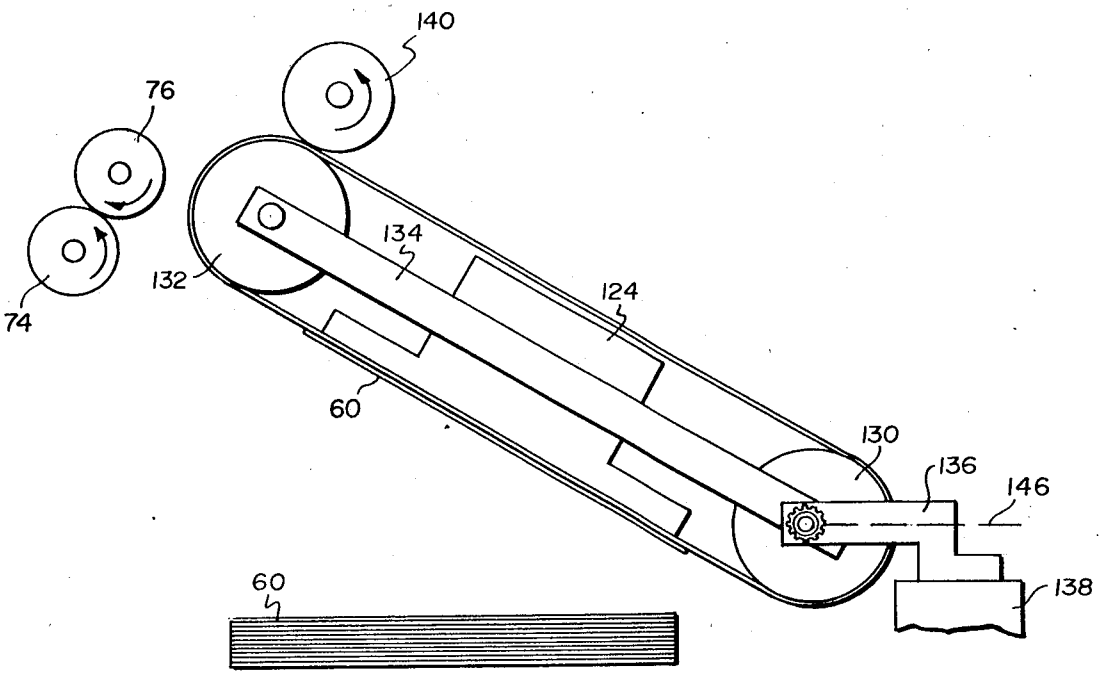
FIG. 3 is a view showing the FIG. 2 cover feeder in a second position.

FIGS. 2 and 3 of the drawings illustrates a preferred embodiment of a cover feeding mechanism 120 for the cover inserter unit 10 of the present invention. The cover feeding mechanism 120 comprises an endless vacuum belt 122 that encircles a vacuum plenum 124. A vacuum blower 126 is shown diagrammatically coupled to the plenum 124 by a vacuum conduit 128.

Belt 122 is trained about a pair of rollers 130, 132. A frame member 134 supports plenum 124, and the rollers 130, 132 are journaled in the ends of the frame member. A similar frame member (not shown) is at the other side of the feeding mechanism 120. Frame member 134 and the similar frame member at the other side of the feeding mechanism are pivotally connected to a U-shaped member 136 which is secured to a support 138 in the unit 10. Thus, vacuum belt 122, the rollers 130, 132, and the vacuum plenum 124 are mounted for pivotal movement between the lowered and raised positions shown in FIGS. 2 and 3, respectively. When the belt and associated parts are in the FIG. 2 position, the top cover in the stack of covers can be attracted to belt 122 by operating the vacuum pump 126. The pump creates a vacuum in plenum 124 to thereby tack the top cover to the belt 122.

When the belt 122 is moved to its raised position shown in FIG. 3, it engages a drive roller 140 that is constantly driven from a motor shown diagrammatically at 142. When belt 122 contacts driven roller 140, the vacuum belt is driven in the direction indicated by arrow 144 thereby to feed the cover tacked to the vacuum belt 122 into the nip defined by rollers 74, 76. After the cover has been received by the rollers 74, 76, feeding mechanism 122 can be lowered to its FIG. 2 position to pick up another cover. The feeding mechanism is moved between its two positions by a suitable drive diagrammatically shown at 146. As explained earlier, an elevator mechanism can be used for raising the trays 56, 58 so that the top covers on the trays are maintained at a level just beneath the cover feeding mechanism.

The operation of the copier/duplicator 12, finisher 14, and cover inserter unit 10 is coordinated by one or more logic and control units (not shown) as disclosed, for example, in the before-mentioned U.S. Pat. No. 4,473,425. This assures that the movement of copy sheets and covers through various parts of the apparatus will be controlled in order to provide the desired finished booklets.

The operation will now be described. Initially it will be assumed that simplex copy sheets delivered along path 22 from the copier/duplicator to the finisher will have the information copied thereon facing downwardly and that duplex copy sheets will have the odd page number of information facing downwardly. Similarly, it will be assumed that sets of copy sheets are fed seriatim in a particular page sequence, i.e., the last page or sheet of information of the booklet is fed first followed by other pages of a booklet seriatim until the last page of a booklet is furnished to the finisher with such last page fed to the finisher comprising the first page or sheet of the finished booklet. It will be also be assumed that a finished booklet is to have both a front cover and back cover. The machine operator loads the covers in trays 56 and 58 with the information on the top surface of the covers comprising the outer surfaces of the covers in the finished booklet. In other words, the top surface of the front covers 60 in tray 56 comprise the front of a finished booklet and the top surface of the back covers 62 in tray 58 comprise the back of a finished booklet booklet.

When the machine operator starts the apparatus, a back cover 62 is first fed from tray 58 and then delivered along sheet paths 86 and 82 to sheet path 44 and to the inverter 100. After the back cover is received between the drive rollers 106, 108 of the inverter, the entire inverter is rotated 180-degrees as indicated by arrow 110 to thereby invert the back cover. Then the back cover is fed to the binder 14. Next a set of copy sheets from copier/duplicator 14 is fed seriatim along path 22, through unit 10 along path 44, and then into the finisher 14. A front cover 60 is fed from tray 56 through sheet paths 68, 82 so that it enters path 44 after the last sheet of a set of sheets passes the intersection of sheet paths 44 and 82. The front cover need not be inverted but is fed directly through inverter 100 to the finisher 14. Finisher 14 is operative to form a booklet from sheets fed to it in the order described above.

In the event the copy sheets received from copier/duplicator 12 are inverted from the desired orientation for forming booklets in finisher 14, then each copy sheet passing through unit 10 will be inverted by the inverter 100 so that they will be properly oriented when received by the finisher 14. Also, if finisher 14 is designed to receive the copy sheets and covers in a different orientation than that described in detail above, the inverter 100 can be operated as required to properly orient the copy sheets and/or covers for delivery to the finisher.

In the preceding description unit 10 has been described in connection with a copier/duplicator and finisher as disclosed in U.S. Pat. No. 4,473,425, for example. However, the unit can be used with other apparatus. For example, the unit can have its inlet connected to other kinds of reproduction apparatus, such as electronic printers, ink jet printers, etc. Also, the outlet of unit 10 can feed sheets and covers to collators, sorters and other types of finishing or sheet collecting apparatus.

The modular cover inserter unit of the present invention provides a number of advantages. First of all, it frees the copy sheet supplies in copier/duplicator 12 for copy sheets instead of dedicating one such supply for booklet covers. This is desirable because many copier/-duplicators are designed to automatically shift from one sheet supply to another when a sheet supply becomes exhausted of copy sheets. Another advantage of the invention is that the covers 60, 62 do not need to pass through the copier/duplicator and thus are less likely to cause jams, especially when the covers are formed from relatively heavy stock. The path for covers from the unit 10 to the finisher 14 is relatively short and straight so that there is little likelihood of jams occurring along the path for covers. Also, covers can be of a size, shape, etc, that not feed reliably through the longer path for copy sheets from a sheet supply in the copier/duplicator.

Another advantage of the present invention is that front and back covers can be different without requiring them to be interleaved because they are stacked on two separate trays in unit 10. Moreover, by having an inverter 100, both the front cover 60s and back covers 62 can be placed in their respective trays in a face-up orientation; i.e., with printed matter to be on the front of the booklet and the back of the booklet facing upwardly in the trays. This simplifies instructions to the machine operator and thus minimizes the likelihood that the covers will be improperly loaded into the unit. In addition, by providing inverter 100 the unit 10 is suitable for use with copier/duplicators and finishers where the sheets from the copier/duplicator must be inverted before they are delivered to the finisher 14. Also, because unit 10 is built as a module, it can easily be added to (or removed from) the combination of the copier/duplicator and finisher in response to the customer's needs.

The invention has been described in detail with particular reference to a preferred embodiment thereof, but it will be understood that variations and modifications can be effected within the spirit and scope of the invention.

We claim:

1. A modular cover inserter unit adapted to be located between a copier/duplicator and means for assembling booklets from sets of copy sheets received from the copier/duplicator, the inserter unit comprising:

a sheet transport having an inlet for receiving sheets from a copier/duplicator and having an outlet for delivering such sheets to the booklet assembling means; the sheet transport having means for feeding sheets along a first path from its inlet to its outlet;

booklet cover support means in the unit for holding a plurality of booklet covers, the support means comprising first and second trays, each of the trays being adapted to support a stack of booklet covers with the top surface of such covers comprising the outer surfaces of the covers in a booklet to be assembled in the booklet assembling means;

cover feeding means for removing covers from the trays and for delivering a removed cover along a second path that leads from the trays to the sheet transport between the inlet and the outlet; and an inverter located along one of said paths and between the trays and the outlet of the sheet transport, the inverter being effective when operated to invert a cover after it is fed from one of the trays and before it reaches the booklet assembling means.

2. The invention as set forth in claim 1 wherein the inverter is located with respect to the sheet feeding means of the sheet transport to invert either (1) copy sheets from the copier/duplicator and/or (2) covers from at least one of the trays.

3. The invention as set forth in claim 1 wherein the cover feeding means comprises an endless vacuum belt having a portion positionable over booklet covers in the support means, means for applying a vacuum to the belt for attaching a cover to the belt, and means for advancing the belt to thereby feed a cover from the support means.

4. The invention as set forth in claim 3 wherein the means for advancing the belt comprises a drive roller engageable with the belt for advancing the belt, and the feeding means further comprises means for moving the belt between (1) a lowered position directly above the booklet covers so that a cover can be tacked to the belt and (2) a raised position spaced from the covers on the support means and wherein the belt is in engagement with the drive roller for moving the cover away from the support means.

5. A cover inserter unit adapted to be located between a copier/duplicator and means for assembling booklets, the unit comprising:

a sheet transport having an inlet for receiving copy sheets from the copier/duplicator and having an outlet for delivering such sheets to the booklet assembling means; the sheet transport having means for feeding sheets along a path from its inlet to its outlet;

first and second trays in the unit, each tray being adapted to receive and hold a plurality of booklet covers with the top surface of such covers comprising the outer surfaces of the covers in a booklet to be assembled in the booklet assembling means;

cover feeding means associated with each tray for removing a cover from the tray and for delivering the removed cover to the path of the sheet feeding means of the sheet transport between the inlet and the outlet of the sheet transport; and means located with respect to the path of travel of covers from the trays to the outlet of the sheet transport for either (1) inverting a cover or (2) not inverting a cover after the cover is fed from one of the trays and before the cover leaves the outlet of the sheet transport and reaches the booklet assembling means.

6. A cover inserter unit adapted to be located between a copier/duplicator capable of producing sets of copy sheets and a finisher for producing booklets from the sets of copy sheets and covers received from the unit, the unit comprising:

a sheet transport having an inlet for receiving copy sheets from the copier/duplicator and having an outlet for delivering such sheets to the booklet assembling means; the sheet transport having means for feeding sheets along a path from its inlet to its outlet;

first and second trays in the unit, each tray being adapted to receive and hold a plurality of booklet covers with the top surface of such covers comprising the outer surfaces of the covers in a booklet to be assembled in the booklet assembling means;

first cover feeding means for removing covers from the first tray and delivering a removed cover to the sheet transport before each set of copy sheets from the copier/duplicator;

second cover feeding means for removing covers from the second tray and delivering a removed cover to the sheet transport after each set of copy sheets from the copier/duplicator; and means located with respect to the path of travel of covers from the second tray to the outlet of the sheet transport for inverting covers from the second tray without inverting covers from the first tray.

* * * * *